US007629730B2

(12) United States Patent
Fujiwara et al.

(10) Patent No.: US 7,629,730 B2
(45) Date of Patent: Dec. 8, 2009

(54) PIEZOELECTRIC ELECTROACOUSTIC TRANSDUCING DEVICE

(75) Inventors: Satoru Fujiwara, Osaka (JP); Yuka Nagata, Osaka (JP)

(73) Assignee: Hosiden Corporation, Yao-shi, Osaka (JP)

( * ) Notice: Subject to any disclaimer, the term of this patent is extended or adjusted under 35 U.S.C. 154(b) by 0 days.

(21) Appl. No.: 11/826,857

(22) Filed: Jul. 19, 2007

(65) Prior Publication Data

US 2008/0018203 A1 Jan. 24, 2008

(30) Foreign Application Priority Data

Jul. 20, 2006 (JP) ..... 2006-197650

(51) Int. Cl.
*H01L 41/00* (2006.01)

(52) U.S. Cl. ..... 310/369; 310/322; 310/324; 310/332

(58) Field of Classification Search ..... 310/332, 310/324, 322; 381/114, 190
See application file for complete search history.

(56) References Cited

U.S. PATENT DOCUMENTS

| | | | | |
|---|---|---|---|---|
| 4,439,640 | A | 3/1984 | Takaya | |
| 5,736,808 | A * | 4/1998 | Szilagyi et al. | 310/322 |
| 5,824,903 | A * | 10/1998 | Nakamura et al. | 73/514.34 |
| 6,263,552 | B1 * | 7/2001 | Takeuchi et al. | 29/25.35 |
| 7,079,661 | B2 * | 7/2006 | Tanaka | 381/190 |
| 7,217,395 | B2 * | 5/2007 | Sander | 422/100 |
| 2002/0130589 | A1 | 9/2002 | Hamada et al. | |
| 2008/0049955 | A1 * | 2/2008 | Fujiwara et al. | 381/190 |

FOREIGN PATENT DOCUMENTS

| | | |
|---|---|---|
| JP | 57121398 | 7/1982 |
| JP | 58019099 | 2/1983 |
| JP | 8-11005 | 8/1990 |
| JP | 927-1096 | 10/1997 |
| JP | 2001-339791 | 12/2001 |
| JP | 2001339793 | 12/2001 |
| JP | 2001 339793 | 12/2007 |

* cited by examiner

*Primary Examiner*—Walter Benson
*Assistant Examiner*—Bryan P Gordon
(74) *Attorney, Agent, or Firm*—Bacon & Thomas, PLLC

(57) ABSTRACT

In order to simultaneously realize both improvements of the acoustic performance of a bimorph piezoelectric electroacoustic transducing device and the productivity, in a bimorph piezoelectric vibrator 10 in which a disk-like first piezoelectric element 12 is bonded to a first principal surface 11*a* of a metal plate 11, and a disk-like second piezoelectric element 13 is bonded to a second principal surface 11*b* of the metal plate 11, the diameter R1 of the first piezoelectric element 12 is different from the diameter R2 of the second piezoelectric element 13. Furthermore, the diameter R2 of the second piezoelectric element 13 is made smaller than the diameter R1 of the first disk-like piezoelectric element 12, and a lead-wire soldering portion 14 is ensured on the second principal surface 11*b* of the metal plate 11 which is in the periphery of the second piezoelectric element 13.

5 Claims, 2 Drawing Sheets

PIEZOELECTRIC ELECTROACOUSTIC TRANSDUCING DEVICE

BACKGROUND OF THE INVENTION

1. Field of the Invention

The present invention relates to a piezoelectric electroacoustic transducing device which is to be incorporated in an electronic apparatus such as a portable telephone, a PDA, a PC, or a digital camera, and which is used as a sound source.

2. Description of the Prior Art

Conventionally, as disclosed in Patent Reference 1 (Japanese Utility Model Publication No. 8-11005), a bimorph piezoelectric electroacoustic transducing device uses a bimorph piezoelectric vibrator in which disk-like piezoelectric elements to be bonded to the faces of a metal plate have the same diameter, and the identical disk-like piezoelectric elements are bonded to the faces of the metal plate, respectively.

SUMMARY OF THE INVENTION

A problem to be solved by the invention is as follows. In the conventional bimorph piezoelectric electroacoustic transducing device, when the diameters of the piezoelectric elements are increased, in consideration of the acoustic performance in which the diameters of the piezoelectric elements are enlarged to the maximum possible extent in a limited space (inside of a frame holding the piezoelectric vibrator) so that the sound pressure level of the low-frequency region is raised to improve the sound quality, a space for soldering lead wires to the metal plate is narrowed, and the workability is very lowered. In the case where such a device has a structure in which the piezoelectric vibrator is supported by the frame via a ring-like support member made a resin film or the like (for example, Japanese Patent Application Laying Open Nos. 9-271096, 2001-339791, and 2001-339793), the support member is deformed by heat, or burn occurs, thereby increasing the failure occurrence rate. When the diameters of the piezoelectric elements are reduced in consideration of the productivity in which the workability of soldering of the lead wires to the metal plate is remarkably improved, and the failure occurrence rate is suppressed to realize cost reduction, the acoustic performance cannot be maintained, and is lowered. Therefore, it is impossible to simultaneously realize both improvements of the acoustic performance and the productivity.

In order to solve the problem, the invention provides a piezoelectric electroacoustic transducing device comprising: a piezoelectric vibrator in which a disk-like first piezoelectric element is bonded to a first principal surface of a metal plate, and a disk-like second piezoelectric element is bonded to a second principal surface of the metal plate; and a frame which holds the piezoelectric vibrator, wherein a diameter of the first piezoelectric element is different from a diameter of the second piezoelectric element. Between the first and second piezoelectric elements, there is no mutual restriction on their diameters. In consideration of the productivity in which the workability of soldering of lead wires to the metal plate is largely improved, and the failure occurrence rate is suppressed to realize cost reduction, therefore, the diameter of the second piezoelectric element is, for example, made smaller than that of the first piezoelectric element, or smaller than conventional one, whereby the space for soldering the lead wires to the metal plate can be expanded and ensured. At the same time, in consideration of the acoustic performance in, which the diameters of the piezoelectric elements are enlarged to raise the sound pressure of the low-frequency region and improve the sound quality, the diameter of the first piezoelectric element is made larger to the maximum possible extent in a limited space (inside of the frame) than that of the second piezoelectric element, or can be larger than conventional one. In the piezoelectric electroacoustic transducing device, therefore, it is possible to simultaneously realize both improvements of the acoustic performance and the productivity. The size relationship between the diameters of the first and second piezoelectric elements may be inverted.

In the piezoelectric electroacoustic transducing device of the invention, preferably, the diameter of the second piezoelectric element is smaller than the diameter of the first piezoelectric element, and a lead-wire soldering portion is ensured on the second principal surface of the metal plate which is in a periphery of the second piezoelectric element.

Preferably, the device further comprises a ring-like support member in which an inner edge portion is bonded to an outer edge portion of the piezoelectric vibrator, and an outer edge portion is bonded to the frame.

Preferably, a bonded length for the inner edge portion of the support member is ensured in an outer side with respect to the lead-wire soldering portion on the second principal surface of the metal plate.

DETAILED DESCRIPTION OF THE PREFERRED EMBODIMENT

Figure 1A:
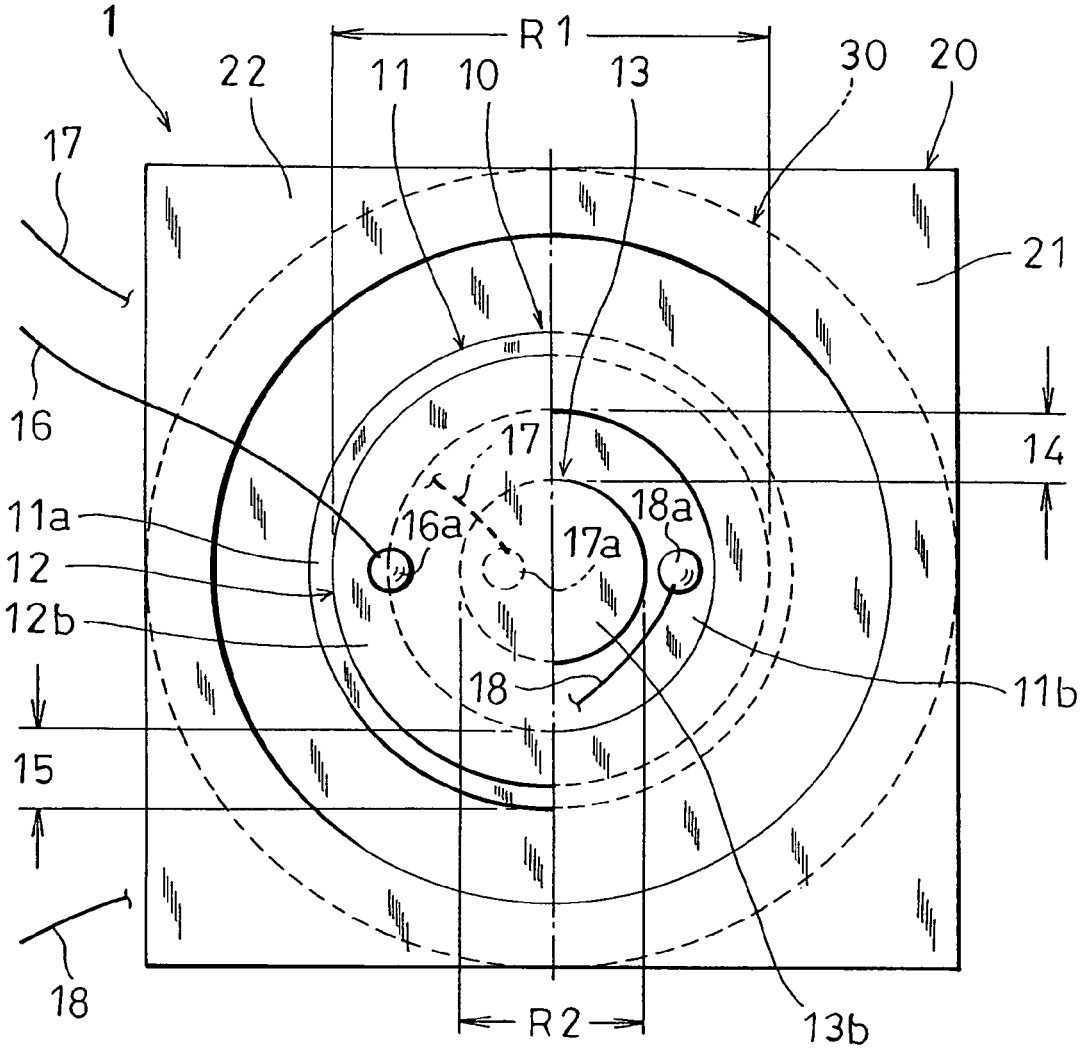
FIG. 1A is a plan view of a piezoelectric electroacoustic transducing device of an embodiment of the invention.

Hereinafter, a piezoelectric electroacoustic transducing device 1 of an embodiment of the invention will be described with reference to the accompanying drawings. The piezoelectric electroacoustic transducing device 1 is configured by: a piezoelectric vibrator 10 in which a thin disk-like first piezoelectric element 12 is concentrically bonded to a first principal surface 11*a* that is the upper face (surface) of a thin disk-like metal plate 11, and a thin disk-like second piezoelectric element 13 is concentrically bonded to a second principal surface 11*b* that is the lower face (rear face) of the metal plate 11; a frame 20 which supports the piezoelectric vibrator 10; and a support member 30 which is disposed between the piezoelectric vibrator 10 and the frame 20.

As the metal plate 11, for example, a metal plate which has a thickness of several tens of μm, and which is made of a nickel-iron alloy, a copper alloy such as brass or phosphor bronze, stainless steel, or the like is preferably used.

In the first piezoelectric element 12, thin-film like electrodes 12*b*, 12*c* are formed on the faces of a thin disk-like piezoelectric member 12*a*, respectively. In the second piezoelectric element 13, similarly, thin-film like electrodes 13*b*, 13*c* are formed on the faces of a thin disk-like piezoelectric member 13*a*, respectively. As the piezoelectric members 12*a*, 13*a*, for example, piezoelectric ceramics of lead zirconate titanate (PZT) having a thickness of several tens of μm are preferably used.

For example, the electrodes 12*b*, 12*c*, 13*b*, 13*c* are formed as thin-film metal electrodes having a thickness of several μm by the evaporation method or the sputtering method, on the faces of the piezoelectric members 12*a*, 13*a*. Alternatively, the electrodes are formed as electrodes which has a thickness of several μm, and which is obtained by performing screen printing on a paste-like electrode material containing a silver component, and then firing it, on the faces of the piezoelectric members 12*a*, 13*a*.

The bonding between the first piezoelectric element 12 and the metal plate 11 is performed by sticking one face of the first piezoelectric element 12 on the side of the electrode 12*c* by an adhesive agent so that, for example, the electrode 12*c* which is on the side of the one face of the first piezoelectric element 12 is electrically conductive with the metal plate 11. Similarly, the bonding between the second piezoelectric element 13 and the metal plate 11 is performed by sticking one face of the second piezoelectric element 13 on the side of the electrode 13*c* by an adhesive agent so that, for example, the electrode 13*c* which is on the side of the one face of the second piezoelectric element 13 is electrically conductive with the metal plate 11.

As described above, the thin disk-like first piezoelectric element 12 is concentrically bonded to the first principal surface 11*a* of the thin disk-like metal plate 11, and the thin disk-like second piezoelectric element 13 is concentrically bonded to the second principal surface 11*b* of the metal plate 11, thereby configuring the piezoelectric vibrator 10 as a bimorph type one.

Figure 1B:
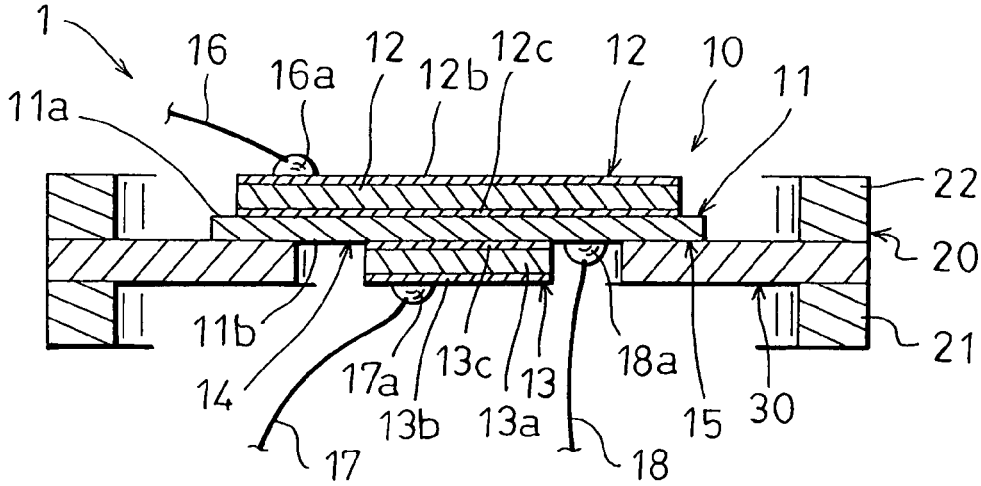
FIG. 1B is a section view of the device.

In the bimorph piezoelectric vibrator 10, the diameter R1 of the first piezoelectric element 12 is different from the diameter R2 of the second piezoelectric element 13. In FIG. 1, the diameter R1 of the first piezoelectric element 12 is made different from the diameter R2 of the second piezoelectric element 13 so that the diameter R2 of the second piezoelectric element 13 is smaller than the diameter R1 of the first piezoelectric element 12 (R1>R2). Alternatively, the size relationship between the diameter R1 of the first piezoelectric element 12 and the diameter R2 of the second piezoelectric element 13 may be inverted from that shown in FIG. 1 (R1<R2).

According to the configuration, the second principal surface 11*b* of the metal plate 11 which is in the periphery of the second piezoelectric element (smaller-diameter piezoelectric element) 13, i.e., a ring-like region outer than the circular bonding region of the second piezoelectric element 13 in the second principal surface 11*b* of the metal plate 11 is ensured as a lead-wire soldering portion 14. The region outside the lead-wire soldering portion 14 of the second principal surface 11*b* of the metal plate 11 which is in the periphery of the second piezoelectric element 13, i.e., a ring-like region of an outer edge portion of the second principal surface 11*b* of the metal plate 11 is ensured as a bonded length 15 for an inner edge portion of the support member 30 which will be described later. In other words, the difference between the diameter R2 of the second piezoelectric element 13 and the diameter of the metal plate 11 allows the ring-like lead-wire soldering portion 14 to be ensured on the second principal surface 11*b* of the metal plate 11 onto which the second piezoelectric element 13 is bonded, and the ring-like bonded length 15 to be ensured outside the portion.

In FIG. 1, the diameter R1 of the first piezoelectric element (larger-diameter piezoelectric element) 12 is slightly smaller than the diameter (outer diameter of the piezoelectric vibrator 10) of the metal plate 11. The diameter R1 can be enlarged to be equal to the outer diameter in the maximum possible extent. In the case where the diameter R1 of the first piezoelectric element 12 is "1", when the diameter R2 of the second piezoelectric element 13 is larger than 0.95, it is difficult to ensure the lead-wire soldering portion 14 and the ring-like bonded length 15 outside the portion which are sufficiently wide for improving the productivity of the piezoelectric electroacoustic transducing device 1. When the diameter R2 is smaller than 0.5, it is difficult to obtain desired frequency characteristics and sound pressure.

The piezoelectric vibrator 10 is of the bimorph type. Therefore, a first lead wire 16 is connected by a solder 16*a* to the non-bonding electrode 12*b* of the first piezoelectric element 12, a second lead wire 17 is connected by a solder 17*a* to the non-bonding electrode 13*b* of the second piezoelectric element 13, and, in the metal plate 11, a third lead wire 18 is connected by a solder 18*a* to the lead-wire soldering portion 14 which is ensured on the second principal surface 11*b* that is in the periphery of the second piezoelectric element 13.

In a state where the first and second lead wires 16, 17 are short-circuited together, a driving voltage is applied from an external circuit between the lead wires and the third lead wire 18, or the driving voltage is applied from the external circuit between the electrodes 12*b*, 12*c* formed on the faces of the first piezoelectric element 12, and between the electrodes 13*b*, 13*c* formed on the faces of the second piezoelectric element 13, thereby producing a radial displacement. This displacement causes the metal plate 11 to deflect, whereby vertical vibration is caused in the piezoelectric vibrator 10 to generate a sound.

A predetermined high voltage is previously applied to the first and second piezoelectric elements 12, 13 so that the elements are polarized in the thickness direction, thereby performing an electric polarizing process. When an electric field in the same direction as the polarization direction is applied to the first piezoelectric element 12, an electric field in the direction opposite to the polarization direction is applied to the second piezoelectric element 13 in order to prevent the displacements of the first and second piezoelectric elements 12, 13 from offsetting each other.

The frame 20 is configured by first and second frame members 21, 22 which clamp an outer edge portion of the support member 30 that will be described later, vertically (in the front and rear direction). The frame members have the same structure. Therefore, only the first frame member 21 will be described, and the description of the second frame member 22 will be omitted. In the first frame member 21, for example, a circular through hole is concentrically opened in a middle portion of a resin or metal plate having a thickness of several hundreds of μm and a substantially square shape. The hole diameter of the first frame member 21 is larger than the outer diameter (diameter of the metal plate 11) of the piezoelectric vibrator 10, and also than the inner diameter of the support member 30 which will be described later, and smaller than the outer diameter of the support member. In the external shape (size) of the first frame member 21, one edge has a length which is substantially equal to the outer diameter of the support member 30 that will be described later. Alternatively, the external shapes of the first and second frame members 21, 22, i.e., the frame 20 may be formed into a circular shape.

The support member 30 is configured by a ring-like resin film, and the like. In the support member 30, for example, a ring-like resin film (single-layer structure) having a thickness of several tens of μm of a polyethylene terephtalate (PET) resin, a polyethylene naphthalate (PEN) resin, a polyether imide (PEI) resin, a polyimide (PI) resin, a polyamide (PA) resin, or the like, or a ring-like resin film having a two-layer structure which is formed by bonding together two such ring-like resin films by an adequate adhesive agent is preferably used. The inner diameter of the support member 30 is substantially equal to the diameter of the boundary between the ring-like lead-wire soldering portion 14 and the ring-like bonded length 15 outside the portion. The outer diameter of the support member 30 is substantially equal to the length of one edge of the frame 20.

The piezoelectric electroacoustic transducing device 1 is assembled by using the above-described components in the following manner. (1) One face of the inner edge portion of the support member 30 is applied and bonded to the ring-like bonded length 15 which is ensured in the outer edge portion of the second principal surface 11*b* of the metal plate 11, by, for example, a rubber elastic adhesive agent of a JIS-A hardness of 40 or less, so that the support member 30 is concentrically attached to the periphery of the piezoelectric vibrator 10. (2) In the other face opposite to the one face of (1) above, the outer edge portion of the support member 30 is applied and bonded to the upper face of the first frame member 21 by, for example, a rubber elastic adhesive agent of a JIS-A hardness of 10 or less, or an acrylic adhesive agent so that the piezoelectric vibrator 10 is concentrically attached to the inner side of the first frame member 21 via the support member 30. (3) The lower face of the second frame member 22 is applied and bonded by an adhesive agent similar to that of (2) above to the face of the outer edge portion of the support member 30 which is opposite to the face of (2), to configure the frame 20 consisting of the first and second frame members 21, 22 which are vertically stacked and integrated together in a state where the outer edge portion of the support member 30 is vertically clamped. In this way, a semifinished product of the piezoelectric electroacoustic transducing device is assembled in which the piezoelectric vibrator 10 is vibratably housed and held via the support member 30 inside the frame 20 in which the upper and lower faces are opened. (4) In the semifinished product of the piezoelectric electroacoustic transducing device, the first lead wire 16 is connected by the solder 16*a* to the non-bonding electrode 12*b* of the first piezoelectric element 12, and the second lead wire 17 is connected by the solder 17*a* to the non-bonding electrode 13*b* of the second piezoelectric element 13. Between the second piezoelectric element 13 bonded to the middle portion of the second principal surface 11*b* of the metal plate 11, and the support member 30 bonded to the outer edge portion of the second principal surface 11*b* of the metal plate 11, the third lead wire 18 is connected by the solder 18*a* to the lead-wire soldering portion 14 which is ensured between the circular bonding region of the second piezoelectric element 13 in the middle portion of the second principal surface 11*b* of the metal plate 11, and the ring-like bonded length 15 of the support member 30 of the outer edge portion of the second principal surface 11*b* of the metal plate 11. As a result, the piezoelectric electroacoustic transducing device 1 is assembled.

Alternatively, the piezoelectric electroacoustic transducing device 1 may be assembled in the following manner. The outer edge portion of the support member 30 is bonded to the upper face of the first frame member 21, the ring-like bonded length 15 which is ensured in the outer edge portion of the second principal surface 11*b* of the metal plate 11 is bonded to the inner edge portion of the support member 30, and thereafter (3) above is performed. Alternatively, the outer edge portion of the support member 30 is bonded to the upper face of the first frame member 21, the lower face of the second frame member 22 is bonded to the outer edge portion of the support member 30 to configure the frame 20, and thereafter (1) above is performed, thereby assembling a semifinished product of the piezoelectric electroacoustic transducing device. The solder connections of the lead wires 16, 17, 18 are performed after the assembling of the semifinished product of the piezoelectric electroacoustic transducing device. In the bonding between the metal plate 11 of the piezoelectric vibrator 10 and the support member 30, a soft adhesive agent was used so that the piezoelectric vibrator 10 easily deflects, for purposes of broadening of the frequency characteristics, and the like. In the bonding between the first and second frame members 21, 22 of the frame 20 and the support member 30, a hard adhesive agent which has a high adhesive strength, and which exhibits a high durability was used so that, when the piezoelectric vibrator 10 is driven, the piezoelectric vibrator 10 and the support member 30, i.e., the vibration system does not disengage from the frame 20. Alternatively, a soft adhesive agent may be used so that a gap which may cause leakage of sound is not formed between the vibration system and the frame 20. The connections of the lead wires 16, 17, 18 may be realized by other bonding means such as welding or a conductive adhesive agent in place of the solders 16*a*, 17*a*, 18*a*. In view of the bonding strength, the durability, the reliability of the electrical connection, the workability, and the like, however, the solder connection is the most effective bonding means.

In the piezoelectric electroacoustic transducing device 1, the circular openings are formed in the upper and lower faces (front and rear faces) of the frame 20, and hence a sound can be emitted from either of the faces. Namely, a sound can be emitted from any one of the side of the piezoelectric vibrator 10 where the first piezoelectric element 12 exists, and that where the second piezoelectric element 13 exists. The frame 20 has a two-piece structure consisting of the first and second frame members 21, 22. In order to more surely integrate the first and second frame members 21, 22 with each other, and to surely maintain the integration, the outer edge portion of the frame 20 may be covered by a metal cover or the like to clamp the first and second frame members 21, 22. The external shape of the frame 20 is formed into a substantially square shape. Alternatively, the external shape may be formed into a circular shape. A frame member having a one-piece structure may be used as the frame 20. In this case, a stepped face is disposed on the inner wall face of the frame member, so that the outer edge portion of the support member 30 is bonded to the stepped face, whereby the piezoelectric vibrator 10 can be held. A ring-like press member may be used so that the outer edge portion of the support member 30 is clamped by the press member and the stepped face in the same manner as the case of the first and second frame members 21, 22.

For example, the piezoelectric electroacoustic transducing device 1 may be mounted inside a sound hole disposed in a housing of a portable telephone, and emit a sound in the front direction with respect to the flat face portion of the piezoelectric vibrator 10. Alternatively, a sound may be emitted in a lateral direction. Ends of the lead wires 16, 17, 18 are solder-connected to predetermined soldering lands of the substrate, respectively, and the device is used as a piezoelectric speaker.

Figure 2:
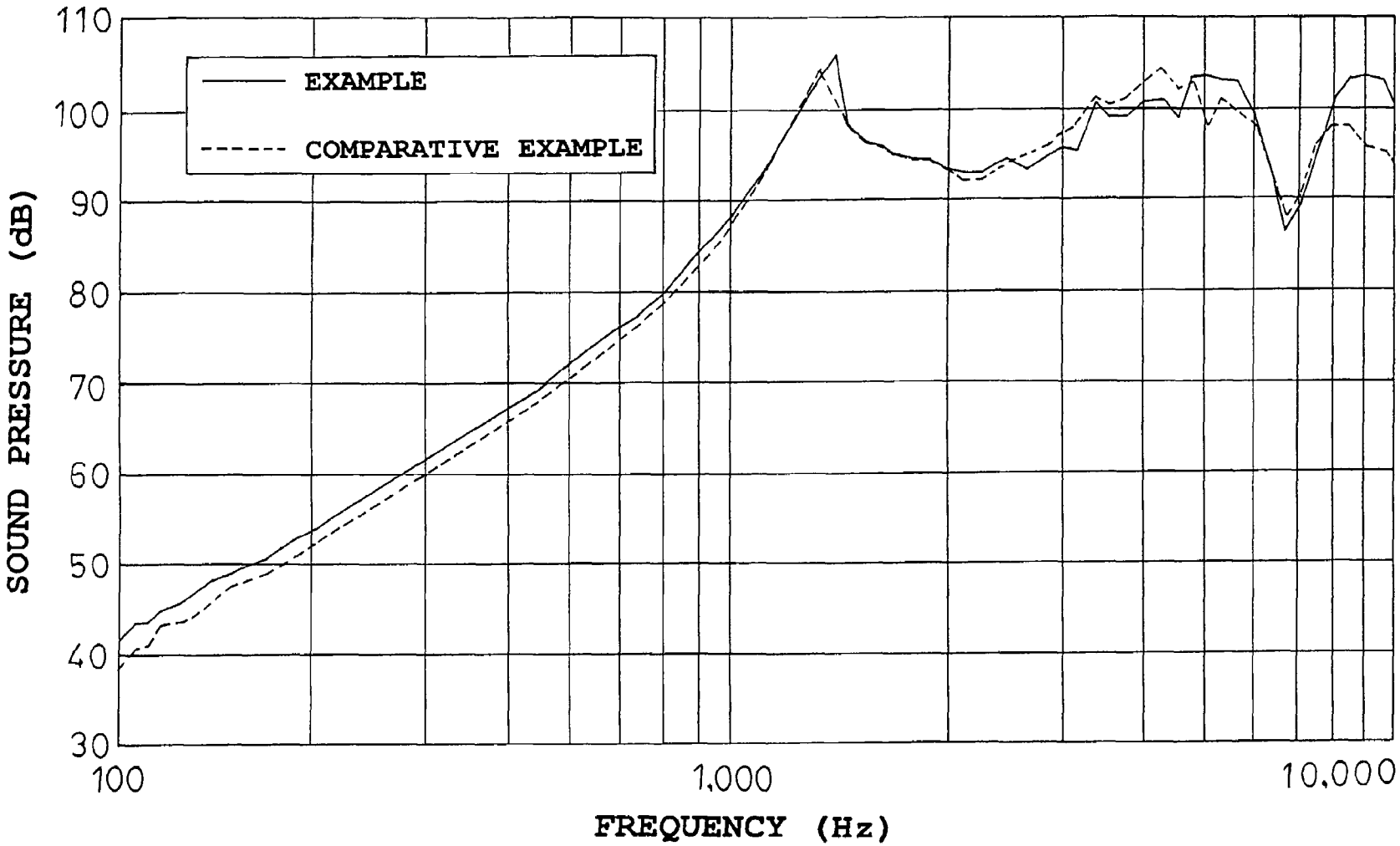
FIG. 2 is a graph showing frequency-sound pressure characteristics of the piezoelectric electroacoustic transducing device of the embodiment of the invention, and a comparative example to be compared therewith.

FIG. 2 is a graph showing frequency-sound pressure characteristics of a piezoelectric electroacoustic transducing device (hereinafter, referred to as example) of an example of the invention having the same structure as the above-described piezoelectric electroacoustic transducing device 1, and a conventional piezoelectric electroacoustic transducing device (hereinafter, referred to as comparative example). In the figure, the example is indicated by the solid line, and the comparative example by the broken line.

The comparative example has the same structure as the example except that the bimorph piezoelectric vibrator 10 configured by bonding together the first and second piezoelectric elements 12, 13 having the same diameter is used.

Each of the example and the comparative example was disposed at a predetermined position, and a microphone was disposed at a position separated by 10 cm from the sound source. A driving voltage of 10 volt was applied between the electrodes 12*b*, 12*c* formed on the faces of the first piezoelectric element 12, and between the electrodes 13*b*, 13*c* formed on the faces of the second piezoelectric element 13, and frequency-sound pressure characteristics were measured. As apparent from FIG. 2, in the example, it will be seen that a higher sound pressure level is obtained in a low-frequency band of lower than 1 kHz as compared with the comparative example. Although not illustrated, in the case where the diameter of the second piezoelectric element 13 of the example is further reduced, a sound pressure level equivalent to that of the example was obtained in a frequency band of 4 kHz or lower, and flat characteristics in which the sound pressure is less lowered as compared with the comparative example and a dip is improved was obtained in a frequency band of 6 to 7 kHz. Therefore, it is presumed that the invention is effective also as a characteristic adjusting method for obtaining flat characteristics.

As seen from the above description, the piezoelectric electroacoustic transducing device 1 comprises: the piezoelectric vibrator 10 in which the disk-like first piezoelectric element 12 is bonded to the first principal surface 11*a* of the metal plate 11, and the disk-like second piezoelectric element 13 is bonded to the second principal surface 11*b* of the metal plate 11; the frame 20 which holds the piezoelectric vibrator 10; and the ring-like support member 30 in which the inner edge portion is bonded to the outer edge portion of the piezoelectric vibrator 10, and the outer edge portion is bonded to the frame 20, and the piezoelectric vibrator 10 is held by the frame 20 via the support member 30.

Furthermore, the diameter R1 of the first piezoelectric element 12 is made different from the diameter R2 of the second piezoelectric element 13. According to the configuration, the diameter R2 of the second piezoelectric element 13 is made smaller than the diameter R1 of the first piezoelectric element 12, the lead-wire soldering portion 14 is ensured on the second principal surface 11*b* of the metal plate 11 which is in the periphery of the second piezoelectric element 13, and the ring-like bonded length 15 for the inner edge portion of the support member 30 is ensured outside the lead-wire soldering portion 14 of the second principal surface 11*b* of the metal plate 11.

Therefore, there is no mutual restriction on the diameters between the first and second piezoelectric elements 12, 13. As a result, in consideration of the productivity in which the workability of soldering of the third lead wire 18 to the metal plate 11 is remarkably improved, and the failure occurrence rate is suppressed to realize cost reduction, the diameter R2 of the second piezoelectric element 13 is made smaller than the diameter R1 of the first piezoelectric element 12 or than the conventional one, and the lead-wire soldering portion 14 to the metal plate 11, i.e., the space for soldering the lead wires can be expanded and ensured as compared with the conventional one. At the same time, in consideration of the acoustic performance in which the diameters of the piezoelectric elements are enlarged to raise the sound pressure level of the low-frequency region and improve the sound quality, the diameter R1 of the first piezoelectric element 12 is made larger to the maximum possible extent in a limited space (inside of the frame 20), or can be made larger than the conventional one.

Therefore, the diameter R1 of the disk-like first piezoelectric element 12 bonded to the first principal surface 11*a* of the metal plate 11 is made different from the diameter R2 of the disk-like second piezoelectric element 13 bonded to the second principal surface 11*b* of the metal plate 11, whereby both improvements of the acoustic performance of the piezoelectric electroacoustic transducing device, and the productivity can be simultaneously realized.

What is claimed is:

1. A piezoelectric electroacoustic transducing devices comprising:

a piezoelectric vibrator including a metal plate having a first principal surface and a second principal surface, a disk-like first piezoelectric element bonded to said first principal surface, and a disk-like second piezoelectric element bonded to said second principal surface; and a frame which holds said piezoelectric vibrator, said frame including a support member for supporting said metal plate, and including an opening providing access to said second principal surface, wherein:

a diameter of said first piezoelectric element is different from a corresponding diameter of said second piezoelectric element.

2. The piezoelectric electroacoustic transducing device according to claim 1, wherein:

the diameter of said second piezoelectric element is smaller than the diameter of said first piezoelectric element; and a lead-wire soldering portion is provided on said second principal surface of said metal plate which is located in said opening and in a periphery of said second piezoelectric element.

3. The piezoelectric electroacoustic transducing device according to claim 1, wherein:

said support member is ring-like having an inner edge portion and an outer edge portion, said inner edge portion being bonded to said metal plate and said outer edge portion being bonded to said frame.

4. The piezoelectric electroacoustic transducing device according to claim 3, wherein:

the diameter of said second piezoelectric element is smaller than the diameter of said first piezoelectric element.

5. The piezoelectric electroacoustic transducing device according to claim 4, wherein:

a bonded length for said inner edge portion of said support member is provided in an outer side with respect to said lead-wire soldering portion on said second principal surface of said metal plate.

* * * * *